United States Patent [19]

Nakashima et al.

[11] Patent Number: 4,988,663

[45] Date of Patent: Jan. 29, 1991

[54] HEAT SENSITIVE PAPER

[75] Inventors: Norihiko Nakashima; Sadashi Ueda, both of Utsunomiya, Japan

[73] Assignee: Kao Corporation, Tokyo, Japan

[21] Appl. No.: 443,163

[22] Filed: Nov. 30, 1989

Related U.S. Application Data

[63] Continuation-in-part of Ser. No. 237,230, Aug. 26, 1988, abandoned.

[30] Foreign Application Priority Data

Aug. 27, 1987 [JP] Japan ..... 62-213522

[51] Int. Cl.[5] ..... B41M 5/18

[52] U.S. Cl. ..... 503/226; 127/152; 503/200

[58] Field of Search ..... 503/200, 206, 226; 427/152

[56] References Cited

FOREIGN PATENT DOCUMENTS

| | | | |
|---|---|---|---|
| 0291315 | 11/1988 | European Pat. Off. . | |
| 116692 | 7/1982 | Japan | 503/226 |
| 2397 | 1/1985 | Japan | 503/226 |
| 0154992 | 7/1986 | Japan | 503/226 |
| 3005981 | 1/1988 | Japan | 503/226 |

OTHER PUBLICATIONS

Patent Abstracts of Japan, vol. 10, No. 311 (M-528) [2367], Oct. 23, 1986 and JP-A-61 123 586 (6-11-86).

Patent Abstracts of Japan, vol. 9, No. 162 (M-394) [1885], Jul. 6, 1985 and JP-A-60 34 894 (2-22-85).

*Primary Examiner*—Pamela R. Schwartz

*Attorney, Agent, or Firm*—Wenderoth, Lind & Ponack

[57] ABSTRACT

Disclosed is a heat sensitive paper comprising;

(a) a base paper, (b) a coating layer on said base paper formed from an acrylic aqueous dispersion containing particles having an average diameter of 0.001 to 0.05 microns prepared by the following steps;

(i) polymerizing of a monomer having a salt-forming group and a polymerizable double bond and a copolymerizable monomer in a hydrophilic organic solvent, (ii) neutralizing the salt-forming group by adding a neutralizing agent to the polymer solution, and (iii) adding water to the polymer solution and distilling away the hydrophilic organic solvent, and (c) a heat sensitive color developing layer comprising a colorless or light color electron donative dye and an electron acceptant compound which reacts with said electron donative dye to develop color, on said coating layer.

5 Claims, No Drawings

HEAT SENSITIVE PAPER

CROSS-REFERENCE TO RELATED APPLICATION

This is a CIP application of the U.S. patent application Ser. No. 237,230, filed Aug. 26, 1988,which is abandoned at the same time of filing this application.

FIELD OF THE INVENTION

The present invention relates to a heat sensitive material. More particularly, it relates to a heat sensitive material which effectively prevents undesirable coloring before heating and which has excellent color development sensitivity.

BACKGROUND OF THE INVENTION

A heat sensitive recording material has been widely used as a recording material for a facsimile machine, a computer, another measuring machine and the like, because of such advantages as being maintenance-free, noiseless, low cost, etc.

It has now been required that the heat sensitive recording material has high heat-sensitivity or develops dark color with low energy, together with speeding up of transmittance of a facsimile machine and of printing out of a computer terminal. In order to accomplish the above requirement, many studies have been done, focusing on improving the heat sensitivity between a thermal head and a heat sensitive material. As the result, the following processes are proposed:

(a) A heat sensitive recording material is calendered to enhance its surface smoothness (see Japanese Patent Publication No. 20142/1977 and Japanese Laid-Open Publication No. 115255/1979).

(b) Paper is made by a cylinder paper machine and then cast-dried on one-side. The cast side is coated with a heat sensitive composition (see Japanese Laid-Open Publication No. 208297/1982).

(c) A base paper supporter of a heat sensitive paper is sized on the surface to prevent decline of the surface smoothness which occurs when coating a heat sensitive composition (see Japanese Laid-Open Publication No. 177281/1986).

If smoothness is enhanced by the calendar treatment, color density increases, but sticking is also increased therewith. Background coloring often occurs by the pressure in the calendar process. In the processes (b) and (c), it is difficult to constantly obtain heat sensitive paper having excellent properties, because its properties vary depending upon physical properties of the heat sensitive composition.

The present inventors have found the fact that the smoothness of the surface is lowered because a binder in the heat sensitive composition penetrates or spreads into paper matrix during coating and that the background coloring occurs because an amount of the binder left on the surface becomes insufficient to divide a dye and a developer. In order to prevent this penetration o spread of the binder into paper, so-called "binder migration", the present inventors intensely studied the problem and found that binder migration is effectively prevented by using an acrylic aqueous resin dispersion containing resin particles having a particle size of 0.001 to 0.05 microns which is prepared by a specific process. A heat sensitive paper which employs this aqueous resin dispersion can effectively prevent undesirable coloring before heating and has excellent color development sensitivity.

SUMMARY OF THE INVENTION

The present invention is to provide a heat sensitive paper comprising;

(a) a base paper, (b) a coating layer on said base paper formed from an acrylic aqueous dispersion containing particles having an average diameter of 0.001 to 0.05 microns prepared by the following steps;

(i) polymerizing of a monomer having a salt-forming group and a polymerizable double bond and a copolymerizable monomer in a hydrophilic organic solvent, (ii) neutralizing the salt-forming group by adding a neutralizing agent to the polymer solution, and (iii) adding water to the polymer solution and distilling away the hydrophilic organic solvent, and (c) a heat sensitive color developing layer comprising a colorless or light color electron donative dye and an electron acceptant compound which reacts with said electron donative dye to develop color, on said coating layer.

DETAILED DESCRIPTION OF THE INVENTION

The acrylic aqueous resin dispersion employed in the present invention generally has resin particles having an average particle size of 0.001 to 0.05 microns in view of penetrability into the base paper and of film-forming properties. If the average particle size is more than 0.05 microns, penetrability and film-forming properties become poor. Average particle sizes of less than 0.001 microns are difficult to produce.

The acrylic aqueous resin dispersion of the present invention should be prepared by the following steps; (i) polymerizing of a monomer having a salt-forming group and a polymerizable double bond and a copolymerizable monomer in a hydrophilic organic solvent, (ii) neutralizing the salt-forming group by adding a neutralizing agent to the polymer solution, and (iii) adding water to the polymer solution and distilling away the hydrophilic organic solvent. The solution polymerizing method can be called "phase inversion method", which is most preferred for the present invention. The phase inversion method can provide particles with a very small particle size of approximately 0.001 micron which are excellent in penetrability into paper and film-forming ability. And this method does not employ a surfactant and therefore has no background coloring.

The monomer having a salt-forming group and a polymerizable double bond generally includes a cationic monomer, an anionic monomer and an amphoteric monomer. Examples of the anionic monomers are unsaturated carboxylic monomers, unsaturated sulfonic monomers, unsaturated phosphoric monomers and the like. Representative examples of the unsaturated carboxylic monomers are acrylic acid, methacrylic acid, crotonic acid, itaconic acid, maleic acid, fumaric acid, citraconic acid, an anhydride thereof and the like. The sulfonic monomers include styrenesulfonic acid, 2-acrylamide-2-methylpropanesulfonic acid, 3-sulfopropyl(meth)acrylic acid ester, bis-(3-sulfopropyl)itaconic ester, a sulfuric monoester of 2hydroxyethyl(meth)acrylic acid, a salt thereof and the like. Also, the unsaturated phosphoric monomers encompass vinylphosphonic acid, vinyl phosphate, acidphosphoxyethyl (meth)acrylate, 3-chloro-2-acidphosphoxypropyl (meth)acrylate, acidphosphoxypropyl (meth)acrylate, bis(methacryloxyethyl)phosphate, diphenyl-2methacryloyloxyethyl phosphate, diphenyl-2-acryloyloxyethyl phosphate, dibutyl-2-methacryloyloxyethyl phosphate, dibutyl-2-acryloyloxyethyl phosphate, dioctyl-2(meth)acryloyloxyethyl phosphate and the like. The cationic monomers include unsaturated tertiary amine-containing monomers, unsaturated ammonium salt-containing monomer, for example monovinylpyridines, such as vinylpyridine, 2-methyl5-vinylpyridine, 2-ethyl-5-vinylpyridine and the like; dialkylamino group-containing styrenes, such as N,N-dimethylaminostyrene, N,N-dimethylaminostyrene and the like; dialkylaminoester of (meth)acrylic acid, such as N,N-dimethylaminoethyl methacrylate, N,N-dimethylaminoethyl acrylate, N,N-diethylaminoethyl methacrylate, N,N-diethylaminoethyl acrylate, N,N-dimethylaminopropyl methacrylate, N,N-dimethylaminopropyl acrylate, N,N-diethylaminopropyl methacrylate, N,N-diethylaminopropyl acrylate and the like; vinyl ethers having a dialkylamino group, such as 2-dimethylaminoethyl vinyl ether and the like; (meth)acrylamides having a dialkylamino group, such as N-(N',N'-dimethylaminoethyl) methacrylamide, N-(N',N'-dimethylaminoethyl) acrylamide, N-(N',N'-diethylaminoethyl) methacrylamide, N-(N',N'-diethylaminoethyl) acrylamide, N-(N',N'-dimethylaminopropyl) methacrylamide, N-(N',N'-dimethylaminopropyl) acrylamide, N-(N',N'-diethylaminopropyl) methacylamide, N-(N',N'-diethylaminopropyl) acrylamide and the like; the above listed compound which is quaternarized with a known quaternarizing agent, for example a halogenated alkyl having 1 to 18 carbon atoms, a halogenated benzyl (such as benzyl chloride or benzyl bromide), an alkyl ester of an alkyl or aryl sulfonic acid (such as methanesulfonic acid, benzenesulfonic acid or toluenesulfonic acid) and an dialkyl sulfate having 1 to 18 carbon atoms. Examples of the amphoteric monomers are (3-sulfopropyl)-N-methacryloyloxyethyl-N,N-dimethylammoniumbetaine, N-(3-sulfopropyl)-N-methacryloylamidopropyl-N,N-dimethylammoniumbetaine, 1-(3-sulfopropyl)-2vinylpyridiniumbetaine and the like.

The copolymerizable monomer reactive with the above mentioned monomer having a salt-forming group and a polymerizable double bond include an acrylic ester, such as methyl acrylate, ethyl acrylate, isopropyl acrylate, n-butyl acrylate, isobutyl acrylate, n-amyl acrylate, iso-amyl acrylate, n-hexyl acrylate, 2-ethylhexyl acrylate, n-octyl acrylate or decyl acrylate, dodecyl acrylate; a methacrylic esters, such as methyl methacrylate, ethyl methacrylate, isopropyl methacrylate, n-butyl methacrylate, isobutyl methacrylate, n-amyl methacrylate, iso-amyl methacrylate, n-hexyl methacrylate, 2-ethylhexyl methacrylate, n-octyl methacrylate, decyl methacylate or dodecyl methacylate; a styrene monomer, such as styrene, vinyltoluene, 2-methylstyrene, 1-butylstyrene or chlorostyrene; a hydroxyl group-containing monomer, such as hydroxyethyl acrylate or hydroxypropyl acrylate; an N-substituted (meth)acrylic monomer, such as N-methylol (meth)acrylamide or N-butoxymethyl (meth)acrylamide; an epoxy group-containing monomer, such as glycidyl acrylate and glycidyl methacrylate; acrylonitrile; and a mixture thereof.

The monomer having a salt-forming group and a polymerizable double bond can be used in an amount of 2 to 25% by weight and the copolymerizable monomer can be used in an amount of 98 to 75% by weight based on the total amount of the both monomers. If the amount of the former monomer is less than 2% by weight, it is difficult to obtain a stable self-dispersible aqueous resin dispersion containing a uniform particle size. Amounts more than 25% by weight do not provide sufficient water resistance in the coated resin layer.

The hydrophilic organic solvent which is employed in the preparation of the aqueous resin dispersion includes ketones, alcohols, esters, ethers or a mixture thereof. Examples of the ketones are acetone, methyl ethyl ketone, diethyl ketone, dipropyl ketone, methyl isobutyl ketone, methyl isopropyl ketone and the like. Preferred is acetone or methyl ethyl ketone. Examples of the alcohols are methanol, ethanol, n-propanol, isopropanol, n-butanol, sec-butanol, tert-butanol, isobutanol, diacetone alcohol, 2-iminoethanol and the like. Preferred is isopropanol, n-propanol, n-butanol, sec-butanol, tert-butanol or iso-butanol. Examples of the esters are an acetic ester. Examples of the ethers are dioxane, tetrahydrofurane and the like.

It is preferred that the hydrophilic organic solvent has a boiling point smaller than water and an azeotropic point. The solvent can also be mixed with a high boiling point hydrophilic organic solvent. Examples of the high boiling point hydrophilic organic solvents are phenoxy ethanol, ethyleneglycol monomethyl ether, ethyleneglycol monoethyl ether, ethyleneglycol monobutyl ether, diethyleneglycol monomethyl ether, diethyleneglycol monoethyl ether, diethyleneglycol diethyl ether, diethyleneglycol monobutyl ether, 3-methyl-3-methoxy butanol and the like.

In order to obtain a uniform and stable aqueous resin emulsion from the above mentioned reactants, a reaction vessel equipped with a stirrer, a condenser, a dropping funnel, a thermometer and a nitrogen gas inlet is charged with the hydrophilic organic solvent. The monomer mixture selected from the above monomers is charged into the dropping funnel, and a radical initiator and, if necessary a chain transfer agent are then added to the monomer mixture in an amount of 0.05 to 5.0% by weight based on the total amount of the monomers. The reaction is carried out with refluxing at 50° C. in nitrogen blanket to accomplish the reaction and a neutralizing agent is added to neutralize the salt-forming group. The neutralizing agent is not needed where the monomer is a quaternary ammonium salt or amphoteric group. Ion-exchanged water is added to the obtained mixture and the low-boiling point hydrophilic organic solvent is distilled away at not more than 50° C. in a reduced pressure. If the salt-forming group is tertiary amine, it is required that a quaternarizing agent is added to quaternarize after terminating the polymer reaction and then ion-exchanged water is added. The radical initiators are those known to the art, for example hydroperoxides, such as t-butylperoxide; dialkylperoxides, such as di-t-butylperoxide; diacylperoxides, such as acetylperoxide; peracid esters, such as t-butyl peracetate; ketone peroxides, such as methyl ethyl ketone peroxide; azo initiators, such as 2,2'-azobis(isobutylonitrile), 2,2'-azobis(2,4-dimethylvaleronitrile), 1.1'-azobis(cyclohexane-1-carbonitrile); and the like.

The obtained aqueous emulsion has almost full transparency and shows the Tyndall phenomenon when laser light is irradiated to the emulsion. It is preferred that the obtained resin emulsion has a number average molecular weight of 2,000 to 200,000.

The acrylic aqueous resin dispersion prepared by the above methods is preferably coated or a size-press part of a paper machine, but may be coated by a blade, an air-knife, a roll-coater and the like. The resin dispersion may contain inorganic pigment, such as calcium carbonate, kaolin, talc, particulate silica, barium sulfate, aluminum hydroxide and the like. The amount of the dispersion on the base paper is generally from 0.5 to 5 g/m$^2$,although it depends upon a porous degree of the base paper.

The electron donative dye employed in the present invention can be a leuco dye, such as triphenylmethanes, fluorans, phenothiazines, auramines, spiropyranes, indolinophthalides, a mixture thereof and the like. More concrete examples of the dyes are 3,3-bis(p-dimethylaminophenyl)-phthalide, 3,3-bis(p-dimethylaminophenyl)-6-dimethylaminophthalide, 3,3-bis(p-dimethylaminophenyl)-6-diethylaminophthalide, 3,3-bis(p-dimethylaminophenyl)-6-chlorophthalide, 3,3-bis(p-dibutylaminophenyl)-phthalide, 3-cyclohexylamino-6-chlorofluoran, 3-dimethylamino-5,7-dimethylfluoran, 3-diethylamino-7-chlorofluoran, 3-diethylamino-7-methylfluoran, 3-diethylamino-7,8-dibenzfluoran, 3-diethylamino-6-methyl-7-chlorofluoran, 3-(N-p-tolyl-N-ethylamino)-6-methyl-7-anilinofluoran, 3-pyrrolidino-6-methyl-7-anilinofluoran, 2-(N-(3'-trifluoromethylphenyl)amino)-6-diethylaminofluoran, 2-(3,6-bis(diethylamino)-9-(o-chloroanilino)xantyl lactam benzoate), 3-diethylamino-6-methyl-7-(m-trichloromethylanilino)-fluoran, 3-diethylamino-7-(o-chloroanilino)fluoran, 3-dibutylamino-7-(o-chloroanilino)fluoran, 3-N-methyl-N-amylamino-6-methyl-7-anilinofluoran, 3-N-methyl-N-cyclohexylamino-6-methyl-7-anilinofluoran, 3-diethylamino-6-methyl-7-anilinofluoran, 3-(N,N-diethylamino)-5-methyl-7-(N,N-dibenzylamino)fluoran, benzoyl leucomethylene blue, 6'-chloro-8'-methoxybenzoindolino-pyrirospyran, 6'-bromo-3'-methoxy-benzoindolino-pyrirospyran, 3-(2'-hydroxy-4'-dimethylaminophenyl)-3-(2'-methoxy-5'-chlorophenyl)phthalide, 3-(2'-hydroxy-4'-dimethylaminophenyl)-3-(2'-methoxy-5'-nitrophenyl)phthalide, 3-(2'-hydroxy-4'-dimethylaminophenyl)-3-(2'-methoxy-5'-dimethylaminophenyl)phthalide, 3-(2'-hydroxy-4'-dimethylaminophenyl)-3-(2'-methoxy-4'-chloro-5'-methylphenyl) phthalide, 3-morpholino-7-(N-propyltrifluoromethylamilino)fluoran, 3-pyrrolidino-7trifluoromethylamilinofluoran, 3-diethylamino-5-chloro-7-(N-benzyl-trifluoromethylanilino)fluoran, 3-pyrrolidino-7-(di-p-chlorophenyl)methylanilinofluoran, 3-diethylamino-5-chloro-7-(alpha-phenylethylamino)-fluoran, 3-(N-ethyl-p-toluidino)-7-(alpha-phenylethylamino)fluoran, 3-diethylamino-7-(o-methoxycarbophenylamino)fluoran, 3-diethylamino-5-methyl-7-(alpha-phenylethylamino)fluoran, 3-diethylamino-7-piperidinofluoran, 2-chloro-3-(N-methyltoluidino)-7-(p-n-butylanilino)fluoran, 3-(N-benzyl-N-cyclohexylamino)-5,6-benzo-7-alpha-naphthylamino-4'-bromofluoran, 3-diethylamino-6-methyl-7-mesytydino-4',5'-benzofluoran, 3,6-dimethoxyfluoran, 3-(p-dimethylaminophenyl)-3-phenylphthalide, 3-di(1-ethyl-2-methylindol)-1-yl-phthalide, 3-diethylamino-6-phenyl-7azofluoran, 3,3-bis(p-diethyaminophenyl)-6-dimethylaminophthalide, 2-bis(p-dimethyaminophenyl)-methyl-5-dimethyaminobenzoic acid, 3-(p-dimethyaminophenyl)-3-(p-dibenzylaminophenyl)phthalide, 3-(N-ethyl-N-n-amyl)amino-6-methyl-7-anilinofluoran and the like.

The electron acceptant compound (color developer) employed in the present invention may be phenols, organic acids and metal salts thereof, hydroxybenzoic ester and the like. Examples of the compounds are salicylic acid, 3-isopropylsalicylic acid, 3-cyclohexylsalicylic acid, 3,5-ditert-butylsalicylic acid, 3,5-di-alpha-methylbenzylsalicylic acid, 4,4'-isopropylidenediphenol, 4,4'-isopropylidenebis(2-chlorophenol), 4,4'-isopropylidenebis(2,6-dibromophenol), 4,4'-isopropylidenebis(2,6-dichlorophenol), 4,4'isopropylidenebis(2-methylphenol), 4,4'isopropylidenebis(2,6-dimethylphenol), 4,4'isopropylidenebis(2-tert-butylphenol), 4,4'-sec-butylidenediphenol, 4,4'-cyclohexylidenebisphenol, 4,4'-cyclohexylidenebis(2-methylphenol), 4-tert-butylphenol, 4-phenylphenol, 4-hydroxydiphenoxide, alpha-naphthol, betanaphthol, 3,5-xylenol, thymol, methyl-4-hydroxybenzoate, 4-hydroxyacetophenone, novolac type phenol resin, 2,2'-thiobis(4,6-dichlorophenol), catechol, resorcinol hydroquinone, pyrogallol, fluoroglycine, fluoroglycinecarboxylic acid, 4-tert-actylcatechol, 2,2'-methylenebis(4-chlorophenol), 2,2'-methylenebis(4-methyl-6-tert-butylphenol), 2,2'-dihydroxydiphenyl, ethyl p-hydroxybenzoate, propyl p-hydroxybenzoate, butyl p-hydroxybenzoate, benzyl p-hydroxybenzoate, p-chlorobenzyl p-hydroxybenzoate, o-chlorobenzyl p-hydroxybenzoate, p-methylbenzyl p-hydroxybenzoate, n-actyl p-hydroxybenzoate, benzoic acid, zinc salicylate, 1-hydroxy-2-naphthoic acid, 2-hydroxy-6-naphthoic acid, zinc 2-hydroxy-6-naphthoate, 4-dihydroxy-4'-chlorodiphenylsulfon, bis(4-hydroxyphenyl)sulfide, 2-hydroxy-p-toluic acid, zinc 3,5-tert-butylsalicylate, tin 3,5-di-tert-butylsalicylate, tartaric acid, oxalic acid, maleic acid, citric acid, succinic acid, stearic acid, 4-hydroxyphthalic acid, boric acid, a thiourea derivative, a 4-hydroxythiophenol derivative and the like.

If the color developer has a high melting point, a thermoplastic material having a low melting point can be incorporated to enhance sensitivity. The thermoplastic material may be homogenized or emulsified before incorporating, or may be melted with the color developer and homogenized before incorporating. It may also be fused to the surface of color developer particles before incorporating. Examples of the thermoplastic materials are those having 50°to 120° C., for example higher fatty amide, such as stearic amide, ercic amide, palmitic amide, ethylenebisstearoamide; wax, such as higher fatty acid ester; and the like.

The dye and color developer are atomized in a dispersant to several microns. The dispersant is a water-soluble polymer solution having a concentration of 10% by weight. Examples of water-soluble polymers are polyvinyl alcohol, starch and a derivative thereof, celluloses (such as methyl cellulose, hydroxyethyl cellulose, carboxymethyl cellulose), synthetic polymers (such as sodium polyacrylate, polyvinyl pyrrolidone, acrylic amide/acrylate copolymer, acrylic amide/acrylate/methacrylic acid copolymer), sodium alginate, casein, gelatin and the like. They can be dispersed by a ball mill, a sand mill, an attritor and the like.

The water-soluble polymer used herein acts as the binder for the heat sensitive paint after coating. In order to impart water resistance to the polymer when acted as the binder, a water-resistance imparting agent, a styrene-butadiene latex or a polymer emulsion such as an acrylic emulsion can be added to the paint.

The heat sensitive paint may further contain various additives. Examples of the additives are materials absorbing oil, such as kaolin, talc, calcium carbonate, aluminum hydroxide, magnesium hydroxide, magnesium carbonate, titanium oxide, fine particulate silica and the like to prevent stains on a recording head. In order to enhance running properties of the head, a fatty acid or metal soap such as stearic acid, behenic acid, aluminum stearate, zinc stearate, calcium stearate, zinc oleate and the like can also be added.

The heat sensitive paint containing the above mentioned compounds is coated on a base paper coated with the aqueous resin emulsion of the present invention by blade, air knife, roll coater or a gravure method. The coated paper is dried and smoothed to form a heat sensitive recording material of the present invention.

EXAMPLES

The present invention is illustrated by the following examples which, however, are not to be construed as limiting the scope of the invention to their details. In the Examples, part and % are all based on weight.

EXAMPLES 1 TO 4 AND COMPARATIVE EXAMPLES 1 AND 2

A reaction vessel equipped with a stirrer, a condenser, a dropping funnel, a thermometer and an inlet for nitrogen gas wa charged with 64 parts of methyl ethyl ketone, 56 parts of butyl acrylate and 8 parts of acrylic acid and nitrogen gas was introduced to remove oxygen dissolved therein. The content of the vessel was heated to 80° C. at which a mixture of 0.13 parts of azobisisobutylonitrile and 2 parts of methyl ethyl ketone wad added thereto to start polymerizing. A solution of 36 parts of butyl acrylate and 36 parts of methyl ethyl ketone, and a mixture of 0.07 parts of azobisisobutylonitrile and 10 parts of methyl ethyl ketone were added the reaction vessel for 3 hours. After the completion of the addition of the monomers, 0.2 parts of azobisisobutylonitrile and 10 parts of methyl ethyl ketone were added to continue the reaction for 2 hours, thus obtaining a copolymer.

The copolymer was neutralized with 11.5 parts of triethylamine. Then, 300 parts of ion exchanged water was added to the solution and methyl ethyl ketone was distilled away at 50° C. in reduced pressure to obtain an acrylic aqueous resin dispersion having a solid content of 25% and a viscosity of 30 cP. The dispersion had a particle size of 0.015 micron as shown in Table 1, which was measured with Coulter Model N4 available from Coulter Electronics Inc.

The obtained aqueous resin emulsion was coated in an amount of 3 g/m$^2$ on a sheet of paper having a weight of 50 g/m$^2$ by a size press apparatus available from Kumagai Riki Kogyo Co., Ltd.

The A, B and C solutions infra are respectively atomized to an average particle size of 3 microns by a sand mill and mixed together to obtain a heat sensitive paint (I). The obtained paint was coated on the paper sheets which were coated with the aqueous resin dispersion as mentioned above, in an amount of 3, 5 and 7 g/m$^2$ solid and then dried, followed by smoothing by a super calendar to obtain heat sensitive paper sheets.

| Heat sensitive paint(I) | |
|---|---|
| A Solution | |
| 3-N-methyl-N-cyclohexylamino-6-methyl-7-anilinofluoran | 10 parts |
| 10% Polyvinyl alcohol solution | 10 parts |
| Water | 10 parts |
| B Solution | |
| 4,4'-Isopropylidene diphenol | 10 parts |
| 10% Hydroxyethylcellulose | 10 parts |
| Water | 10 parts |
| C Solution | |
| Stearic amide | 10 parts |
| Calcium carbonate | 10 parts |
| 10% Polyvinyl alcohol solution | 20 parts |
| Water | 20 parts |

The heat sensitive material obtained above was subjected to a dynamic color-development test by a printing tester available from Okura Denki K.K. to evaluate color density and blushing (color density at non-printing portion) at a printing energy of 0.45 mj/dot. Color density was determined by a Macbeth RD-918 densitometer. The result is shown in Table 2.

TABLE 1

| | Components | Production method size (micron) | Average particle |
|---|---|---|---|
| Example | | | |
| 1 | Acrylic acid (8)/butyl acrylate (92) | Phase inversion | 0.005 |
| 2 | Acrylic acid (10)/ methyl methacrylate (90) | Phase inversion | 0.01 |
| 3 | Itaconic acid (6)/ ethyl methacrylate (94) | Phase inversion | 0.152 |
| 4 | Styrene sulfonic acid (8)/ methyl acrylate (92) | Phase inversion | 0.008 |
| Comparative 1 | Butyl acrylate | Emulsion polymerization | 0.25 |
| 2 | Water | | |

The numerals denote the amount of monomer in unit of parts employed in polymerization reaction.

EXAMPLE 2 to 4

Resin dispersions were prepared as generally described in Example 1 with the exception that the monomers showing in Table 1 were employed. Heat sensitive materials were prepared as generally described in Example 1, employing each the resin dispersions, and the same test was conducted. The results are shown in Table 2.

COMPARATIVE EXAMPLE 1

A reaction vessel equipped with a stirrer, a condenser, a dropping funnel, a thermometer and a nitrogen introduce inlet was charged with 10 parts of Neopelex F-25 (alkylbenzenesulfonic acid salt available from Kao Corporation), 300 parts of deionized water, 0.2 parts of potassium persulfate and 10 parts of butyl acrylate, and heated to 75° C. After starting polymerization, 65 parts of butyl acrylate was added dropwise for 2 hours and then allowed to stand at 80° C. for one hour. The obtained dispersion had a particle size indicating in Table 1.

A heat sensitive material was prepared using the above obtained resin dispersion as generally described in Example 1 and the same test was conducted. The results are shown in Table 2.

COMPARATIVE EXAMPLE 2

A heat sensitive material was prepared as generally described in Example 1, with the exception that water is coated on a sheet of paper instead of the resin dispersion, and the same test was conducted. The results are shown in Table 2.

TABLE 2

| Example number | Dynamic color density Coating amount 3 g/m² | 5 g/m² | 7 g/m² | Background coloring at non-printing portion (coating amound 7 g/m²) |
|---|---|---|---|---|
| 1 | 1.35 | 1.41 | 1.42 | 0.05 |
| 2 | 1.35 | 1.40 | 1.41 | 0.06 |
| 3 | 1.36 | 1.41 | 1.40 | 0.05 |
| 4 | 1.34 | 1.41 | 1.43 | 0.05 |
| Comparative Example 1 | 1.05 | 1.18 | 1.30 | 0.10 |
| 2 | 0.78 | 1.02 | 1.24 | 0.13 |

As is apparent from the above result, the heat sensitive materials of the present invention has a high color density even at such a low coating amount as 3 g/m² and has no blushing at non-printing portion. The comparative heat sensitive materials is poor in color density at such a high coating amount as 7 g/m² and shows blushing at non-printing portion. It is believed that the comparative materials show bad properties because the heat sensitive paint penetrates into pores in the base paper.

What is claimed is.

1. A heat sensitive paper comprising;
(a) a base paper,
(b) a coating layer on said base paper formed from an aqueous dispersion containing acrylic particles having an average diameter of 0.001 to 0.05 microns said aqueous dispersion being prepared by the following steps;
(i) polymerizing a monomer having a salt-forming group and a polymerizable double bond and a copolymerizable monomer in a hydrophilic organic solvent,
(ii) neutralizing the salt-forming group by adding a neutralizing agent to the polymer solution, and
(iii) adding water to the polymer solution and distilling away the hydrophilic organic solvent, and
(c) a heat sensitive color developing layer comprising a colorless or light color electron donative dye and an electron acceptant compound which reacts with said electron donative dye to develop color, on said coating layer.

2. The heat sensitive paper according to claim 1 wherein said aqueous dispersion further contains an inorganic pigment.

3. The heat sensitive paper according to claim 1 wherein said aqueous dispersion is coated on the base paper in an amount of 0.5 to 5 g/m².

4. The heat sensitive paper according to claim 1 wherein said monomer having a slat-forming group and a polymerizable group is selected from the group consisting of acrylic acid and styrenesulfonic acid.

5. The heat sensitive paper according to claim 1 wherein said monomer having a salt-forming group and a polymerizable group is employed in an amount of 2 to 25% by weight and said polymerizable monomer is employed in an amount of 98 to 75% by weight.

* * * * *